United States Patent [19]

Sadowski et al.

[11] Patent Number: 4,761,671

[45] Date of Patent: Aug. 2, 1988

[54] ELECTROPHOTOGRAPHIC SUBPROCESS FOR APPARATUS USING DISCHARGED AREA TONING

[75] Inventors: Michael D. Sadowski, Hilton; Philip Alesio; Catherine D. Newell, both of Rochester, all of N.Y.

[73] Assignee: Eastman Kodak Company, Rochester, N.Y.

[21] Appl. No.: 9,853

[22] Filed: Feb. 2, 1987

[51] Int. Cl.[4] ..... G03G 21/00

[52] U.S. Cl. ..... 355/3 R; 355/14 CH; 430/97; 430/902

[58] Field of Search ..... 355/3 R, 14 R, 14 D, 355/14 E, 14 CH; 430/97, 126, 902

[56] References Cited

U.S. PATENT DOCUMENTS

| | | | |
|---|---|---|---|
| 3,661,452 | 5/1972 | Hewes et al. | 355/67 X |
| 3,892,481 | 7/1975 | Schaefer et al. | 355/14 D X |
| 4,017,170 | 4/1977 | Komori et al. | 355/3 R |
| 4,050,806 | 9/1977 | Miyakawa et al. | 355/14 D |
| 4,286,031 | 8/1981 | Kuehnle et al. | 430/44 |
| 4,416,533 | 11/1983 | Tokunaga et al. | 355/4 |
| 4,470,693 | 9/1984 | Dolan | 355/15 |
| 4,500,198 | 2/1985 | Daniels | 355/14 D |

OTHER PUBLICATIONS

Beckmore et al, "A Method of Contrast Control in Continuous-Tone Xerography", PS&E, vol. 3, No. 5, p. 210 (1959).

Giaimo et al, "System Aspects of Electrophotographic Materials and Processing for Liquid Reversal Toning", RCA Review, vol. 32, p. 139 (1971).

*Primary Examiner*—Fred L. Braun

*Attorney, Agent, or Firm*—Leonard W. Treash

[57] ABSTRACT

A subprocess is useful in start-up and shutdown of electrophotographic apparatus of the type designed to tone discharged areas. During the subprocess, a photoconductive member passing through a toning station is subjected to an electrical field tending to inhibit toning even of discharged areas. This permits discharging of the photoconductive member as part of shutdown, start-up or sitting idle. Preferably, the photoconductive member is uniformly discharged directly before the toning station which reduces pickup of developer carrier as well as otherwise benefiting the member.

2 Claims, 1 Drawing Sheet

ELECTROPHOTOGRAPHIC SUBPROCESS FOR APPARATUS USING DISCHARGED AREA TONING

Technical Field

This invention relates to electrophotography and more specifically to a subprocess for use with an electrophotographic apparatus of the type in which the discharged areas on a photoconductive element are toned in normal operation.

Background Art

In the conventional electrophotographic process a photoconductive member is uniformly charged and then imagewise exposed leaving a pattern of charged areas and discharged areas. In ordinary positive to positive (pos-pos) copying the charged areas are toned by the application of toner which is charged to a polarity opposite to the original charge on the photoconductor.

Some processes use discharged area toning. In such processes the toner is charged to the same polarity as the original charge on the photoconductive member and migrates to the discharged areas. This is sometimes associated with the terms "negative to positive (neg-pos) electrophotography" or "reversal development." Discharged area toning is useful when reproducing positive images from negative microfilm or in writing from an electronic source.

In both types of electrophotography a development electrode is used to control toning. The development electrode is commonly biased to a potential in between the potentials of the charged and discharged areas to encourage toner to move to the areas to be toned, commonly called the image areas, and inhibit toner from moving to the areas not to be toned, commonly called the background areas. Typically, in both systems the bias is set closer to the potential in the background areas than to the potential in the image areas. Thus, if the unexposed areas have a potential of 600 volts and the exposed areas have a potential of 100 volts, an ordinary pos-pos development might set the development electrode bias at between 150 and 200 volts. The comparable setting in a discharged area toning system would be between 450 and 500 volts. In both systems such settings will give good density toning in the image areas while inhibiting background toning.

Electrophotographic apparatus which use what is known as a two component toning system have a problem when some of the carrier particles used in such systems become attracted to the photoconductor along with the toner. This problem is well known, causing image artifacts, incomplete transfer and wear on the cleaning station and the photoconductive member. It is caused or accentuated by a large difference in the bias between the development electrode and the opposing charge on the photoconductor.

In electrophotographic processes in which the photoconductive member is reused continuously, it has been found that the life of the photoconductor is extended if charge is removed from it before periods of nonuse. As a result, most electrophotographic apparatus involving reusable photoconductors move the photoconductor past an erase lamp or AC discharge as part of its shutdown subprocess, while the primary charger is turned off. It also is common to move the photoconductor past an erase lamp or AC corona discharging device during "cycle up" to remove any spurious charges that may have accumulated during the down time and start the photoconductive member "fresh." These subprocesses face a special problem in processes in which the discharged areas are toned because a uniformly discharged photoconductive member will now be completely toned by normal operation of the toning apparatus.

DISCLOSURE OF THE INVENTION

It is the object of the invention to provide a subprocess for apparatus using discharged area toning, which subprocess is useful during start-up and/or shutdown of the apparatus and which will permit storage of the photoconductive member in the apparatus in at least a partially discharged state without excessive unwanted toning during the subprocess.

This and other objects are accomplished according to the invention by use of a subprocess which includes the step of subjecting the member to what normally would be the toning step of the process in the presence of an electric field that tends to inhibit toning of the discharged portions of the member.

With this subprocess the entire or a portion of the photoconductive member can be intentionally discharged prior to complete shutdown of the apparatus or at the beginning of start-up of the apparatus or unintentionally while shutdown, but without the discharged photoconductive member being toned when it passes through the toning portion of the apparatus. Thus, according to preferred embodiments of the invention, the subprocess also includes the step of uniformly discharging the photoconductive member. This discharging step can be accomplished by uniformly discharging the photoconductive member with either an erase lamp, an AC discharging device or both. If two component toning is used, uniform discharging prior to subjection to what would normally be the toning step, but with the toning inhibiting field applied, reduces pickup of unwanted carrier particles by the photoconductive member.

Also according to a preferred embodiment of the invention, the toning inhibiting electric field in the toning step is created by a bias on a development electrode which, during the subprocess, is at a level equal to, less than or opposite to the charge on the discharged portions of the photoconductive member and the application of the toning inhibiting electric field is timed to be applied to only that portion of the photoconductive member that has been uniformly discharged.

BEST MODE OF CARRYING OUT THE INVENTION

Figure 1:
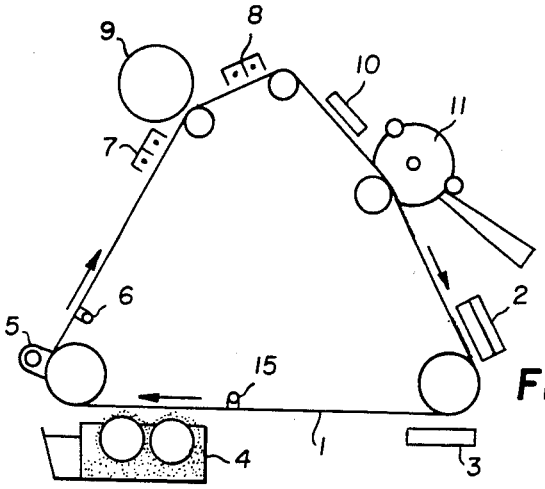
FIG. 1 is a schematic diagram of an electrophotographic apparatus useful in carrying out the invention.

According to FIG. 1 an electrophotographic apparatus, for example, a non-impact printer, employs discharged area toning or development. A photoconductive member 1 (shown as a partially transparent continuous web) is cycled through a series of stations which include a primary corona charger 2 which lays down an initial uniform charge on the photoconductive member.

An exposing station, for example an LED aray 3, exposes image portions of the photoconductive member 1 to discharging radiation, creating a charge pattern on the photoconductive member. Toner is applied to the charge pattern at a toning station 4 in the presence of an electric field which tends to encourage toning of the discharged portions and to inhibit toning of the charged portions to form a toner pattern on the photoconductive member 1. The toner pattern then passes under a magnet device 5 which removes most of any magnetic carrier that may have inadvertently been picked up by the photoconductive member during toning.

The toner pattern is utilized by transferring it to a receiving sheet. More specifically, the toned photoconductive member is exposed to a pretransfer erase light 6 which tends to discharge the charge between the toner and the photoconductive member 1 to facilitate transfer. The loosely adhered toner image is transferred to a receiving sheet (not shown) at a first transfer station 7 under influence of a corona discharge of a polarity opposite to that imposed at the primary charging station. The receiver sheet is inverted at an inverting station 9 and proceeds to a second transfer station 8 where it receives an image on the opposite side from where it is removed from the photoconductive member and fed to a fuser (not shown) and an output hopper (not shown) by a suitable means (not shown). The member 1 at this point is passed under a precleaning corona charger 10 to further loosen any toner particles remaining on the surface for cleaning, which is accomplished at a cleaning station 11. The photoconductive member 1 is now ready for reuse in the electrophotographic process.

Figure 2:
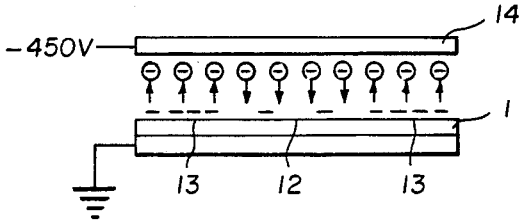
FIG. 2 is a schematic diagram illustrating the toning portion of the electrophotographic process during normal operation.

FIG. 2 schematically shows the toning process in normal discharged area toning. In this mode, the primary corona charger 2 places a uniform charge on the photoconductive member, for example −600 volts. The LED array 3 discharges only those portions of the photoconductive member that it is desired to tone, i.e., discharged image portions 12. The portions of the photoconductive member that have not been exposed to discharging radiation by the LED array 3, charged background areas 13, still have the charge of −600 volts. The portions of the photoconductive member that are exposed by the LED array 3 have been discharged according to the amount of that exposure. For example, these discharged areas are discharged to −120 volts.

The toner is charged negatively, to be rejected by the background portion. For normal operation, a development electrode 14 is biased to a level between the potentials on the two areas 12 and 13 but preferably closer to the background areas 13. In the example shown in FIG. 2, the development electrode is biased to −450 volts which gives substantial development in the image areas 12 while inhibiting development of the background areas 13. This process is well known in the art and is essentially the same in both "pos-pos" and "neg-pos" systems. The bias is commonly adjusted manually or automatically according to the life of the materials used, the density desired and the type of image being produced, as has been well within the skill of the art for many years.

After the apparatus has finished a run, it is common to discharge the photoconductive member so thta it is not idle for extended lengths of time with substantial electrical stress on it. In ordinary positive-positive processes this is accomplished by passing the photoconductive member under an erase lamp or an AC biased corona with the primary charger turned off. However, if a discharged photoconductive member goes through a toning station which is operating as shown in FIG. 2, the entire photoconductive member will be toned, causing a waste of toner, excessive use of the cleaning station and creating more charges on the photoconductive member.

Figure 3:
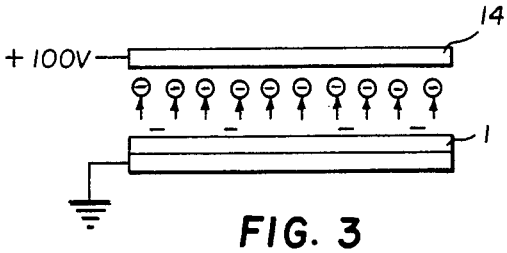
FIG. 3 is a schematic diagram illustrating the toning portion of the process when in its start-up and/or shutdown subprocess.

According to a preferred embodiment of the invention, this problem is solved by placing an auxiliary erase lamp 15 immediately prior to the toning station. The auxiliary erase lamp is turned on only in the start-up or shutdown subprocess. In the preferred shutdown subprocess, the entire photoconductive member is passed under the erase lamp with the primary charger off to leave the member in a discharged state. As the portion of the photoconductive member 1 discharged by the auxiliary erase lamp 15 reaches the toning station 4 the bias on development electrode 14 is adjusted to inhibit toning. This is illustrated in FIG. 3 where the bias on the development electrode is shown at +100 volts. A very slight charge left on the photoconductive member 1 (say, −60 volts) cooperates with the development electrode 14 to create an electrical field that inhibits the toning of the discharged photoconductive member 1. That is, the negatively charged toner is inhibited from migration to the discharged or slightly negatively charged member 1 by the field between the positively biased development electrode and the member.

The actual size of the bias placed on the development electrode 14 when it faces the uniformly discharged photoconductive member 1 must be worked out by the person skilled in the art for the materials and conditions in question. In general, the field is preferably created by a bias equal to, less than or opposite to whatever small charge is remaining on the photoconductive member 1 after it has passed through the discharging step. With the bias on the development electrode set a +100 volts as shown in FIG. 3 not only is the photoconductive member 1 not toned, but the small difference in bias between the development electrode and the photoconductive member does not encourage substantial pick-up of carrier particles, whatever their charge.

It will be understood that the charge potentials and polarities are by way of example, and that this invention is applicable using positively charged materials and with materials and configurations dictating potentials of differing levels.

The timing of the change in bias at the toning station is important to best operation of the subprocess. In normal operation, the photoconductive member contains substantial charge which is not being toned by normal operation of the toning station as shown in FIG. 2. When the photoconductive member is uniformly discharged by the auxiliary erase lamp 15 it creates an area that would be heavily toned when operating in the FIG. 2 normal operation, directly adjacent that area that would not be toned in normal operation. The toning station shown in FIG. 1 has two magnetic brushes that extend over a photoconductive member length of 15 to 20 centimeters. If the bias is adjusted to the FIG. 3 level (from −450 V to +100 V) just as the discharged area reaches the beginning of the toning station 4, the portion of the photoconductive member that still contains a full charge and is still in the toning station will have a tendency to attract carrier which may be positively charged to the photoconductive member. This is because of the substantial difference in bias between the charged photoconductive member, −600 volts in the example, and the development electrode, now biased to +100 volts as in FIG. 3. If the bias is changed to the FIG. 3 level as the beginning of the discharged area is leaving the development station, substantial portions of the discharged area already in the toning station will have been toned. This is because the bias on the development electrode, −450 volts in the example, encourages such toning. The best timing will vary from apparatus to apparatus. It can be determined empirically by a person skilled in the art by measuring the amount of carrier picked up by the magnet device 5 and comparing it with unwanted toning for different timings. We have found that, for the structure shown in FIG. 1, the best results are achieved when the bias is shifted from the FIG. 2 to the FIG. 3 levels just as the beginning of the discharged area reaches the second or downstream magnetic brush.

Depending upon the configuration of the apparatus, the subprocess need not subject the entire length of the photoconductive member to the erase lamp. For example, in start-up it may be satisfactory not to turn the erase lamp on at all, but to adjust the bias on the development electrode to the FIG. 3 level only until the primary charger is fully operational and the portion charged by it has reached the toning station. For best operation, however, it is desirable to use the erase lamp 15 to clean off any beginning charge that might encourage pick up of carrier when that portion of the member 1 is in a toning station biased as in FIG. 3.

The erase lamp shown in FIG. 1 is the preferred mechanism for uniformly discharging the photoconductive member, but other mechanisms can be used. For example, an unbiased or slightly biased AC corona discharge from a suitable source can be used. The precleaning corona charger 10 is commonly slightly negatively biased to loosen toner and to overcome the effects of a strong positive corona at the transfer station. With the primary charger turned off, it has the effect of uniformly discharging member 1. The positive transfer coronas can have the same effect especially if the photoconductive member 1 holds only a negative charge as is commonly the case. The combination of erase lamp 15 and corona discharger 10 with some materials and configurations can effectively discharge the entire member 1 with less than a complete cycle.

If a jam or other urgent problem causes what is known as a "hard" shutdown of the apparatus, the same timing considerations apply. Inertia of the machine causes some continued movement of charged member 1 after the hard shutdown is signalled. The bias on electrode 14 should remain at the FIG. 2 level for this movement. Upon start-up after hard shutdown, the erase lamp can be turned on for a short period. The bias on electrode 14 should remain at the FIG. 2 level until the discharged portion reaches the best position associated with the development station, (as discussed above), at which point it is changed to the FIG. 3 level. The erase lamp is turned off prior to any exposed portions reaching it and the bias on electrode 14 adjusted in time with that turnoff.

INDUSTRIAL APPLICABILITY

This invention has applicability in any electrophotographic process using a reusable photoconductive member in which in normal operation the discharged areas are toned. This makes it particularly useful in non-impact printers and in producing positive images from negative originals as in microfilm printers.

The invention has been described in detail with particular reference to a preferred embodiment thereof, but it will be understood that variations and modifications can be effected within the spirit and scope of the invention.

We claim:

1. In an electrophotographic process for use in an apparatus which, in normal operation, includes the steps of:

placing an electrostatic charge of a first polarity on a photoconductive member;

imagewise exposing the member to create a charge pattern including at least partially discharged image portions;

contacting said pattern with a mixture of toner and carrier said toner being charged to the first polarity and said carrier to an opposite polarity in the presence of an electric field which tends to encourage toning of the discharged image portions to form a toner pattern;

transferring the toner pattern to a receiving member;

cleaning the photoconductive member of residual toner remaining after the transferring step, and reusing the photoconductive member;

the improvement comprising, after a period of such normal use of the apparatus and prior to a period of nonuse, moving the photoconductive member past a discharging station to place the member in a discharged condition, while subjecting the photoconductive member to what would normally be the toning step in the presence of an electric field that tends to inhibit toning of the discharged portions without encouraging deposition of carrier thereon.

2. In an electrophotographic process for use in an apparatus which, in normal operation, includes the steps of:

placing an electrostatic charge of a first polarity on a photoconductive member;

imagewise exposing the member to create a charge pattern including at least partially discharged image portions;

contacting said pattern with a mixture of toner and carrier said toner being charged to the first polarity and said carrier to an opposite polarity in the presence of an electric field which tends to encourage toning of the discharged image portions to form a toner pattern;

transferring the toner pattern to a receiving member;

cleaning the photoconductive member of residual toner remaining after the transferrring step, and reusing the photoconductive member;

the improvement comprising, prior to such use in normal operation after a period of nonuse of the apparatus, moving the photoconductive member past a discharging station to place the member in a discharged condition prior to being used while subjecting the photoconductive member to what would normally be the toning step in the presence of an electric field that tends to inhibit toning of the discharged portions without encouraging deposition of carrier thereon.

* * * * *